US012203272B1

(12) United States Patent
Kroboth

(10) Patent No.: US 12,203,272 B1
(45) Date of Patent: Jan. 21, 2025

(54) TARP SUPPORT APPARATUS AND SYSTEM

(71) Applicant: Anthony F. Kroboth, Lehighton, PA (US)

(72) Inventor: Anthony F. Kroboth, Lehighton, PA (US)

( * ) Notice: Subject to any disclaimer, the term of this patent is extended or adjusted under 35 U.S.C. 154(b) by 0 days.

(21) Appl. No.: 18/178,284

(22) Filed: Mar. 3, 2023

(51) Int. Cl.
*E04F 10/02* (2006.01)

(52) U.S. Cl.
CPC ..... *E04F 10/02* (2013.01)

(58) Field of Classification Search
CPC E04F 10/02; E04F 10/10; E04F 10/06; E04B 1/12
See application file for complete search history.

(56) References Cited

U.S. PATENT DOCUMENTS 1,991,358 A * 2/1935 Bessy ..... E04F 10/02 248/273
2,097,704 A * 11/1937 Smith ..... E04F 10/02 160/81
2,754,974 A 7/1956 Larson
3,612,145 A * 10/1971 Darula ..... E04F 10/0681 160/67
3,653,711 A 4/1972 De Claire et al.
3,720,438 A * 3/1973 Johnson ..... E04H 15/08 160/46
3,851,848 A * 12/1974 Wiele ..... E04F 10/02 55/483
4,094,415 A 6/1978 Larson
4,192,112 A * 3/1980 Reilly, Sr. ..... E04F 10/0633 160/46
5,148,640 A * 9/1992 Reilly, Sr. ..... E06B 9/40 52/74
5,174,352 A * 12/1992 Murray ..... E04F 10/0614 160/67

(Continued)

FOREIGN PATENT DOCUMENTS

TW 329053 B 8/2010
TW 346607 B 8/2011
TW 382900 B 1/2013

*Primary Examiner* — Beth A Stephan
(74) *Attorney, Agent, or Firm* — Wilkinson Law Office; Clinton H. Wilkinson

(57) ABSTRACT

A tarp support apparatus comprising an elongated structural member securable to a support surface including upper and lower longitudinally extending parallel track sections each having an interior channel and a longitudinal slot which opens into the interior channel, a plurality of fastener devices each having a base member configured to be positioned in the lower track section, and a connector member which is joined to the base member and configured to secure a tarp to the fastener device, and an elongated diverter member including a base configured to be positioned in the upper track section, and an articulating extension member joined to the base member and configured to extend over the connector member of the fastener device, said structural apparatus configured to support a tarp extending over a ground area under tension in a stretched orientation, with the distal end of the extension member articulated into physical contact with the tarp to direct rain away from gaps formed between the structural member and an edge of the tarp, which the distal end may be weighted.

20 Claims, 5 Drawing Sheets

(56) References Cited

U.S. PATENT DOCUMENTS

| | | | | |
|---|---|---|---|---|
| 5,190,066 | A * | 3/1993 | Joergensen | E04H 15/08 135/88.13 |
| 5,996,666 | A | 12/1999 | Denina | |
| 6,131,638 | A * | 10/2000 | Levin | E04F 10/0681 160/71 |
| 6,279,641 | B1 * | 8/2001 | Malott | E04F 10/08 160/67 |
| 7,882,965 | B1 | 2/2011 | Kao | |
| 9,499,990 | B1 * | 11/2016 | Rodriguez | E04F 10/08 |
| 2003/0172568 | A1 * | 9/2003 | Uccello | G09F 15/0025 40/590 |
| 2006/0070310 | A1 | 4/2006 | Oliver | |
| 2006/0186697 | A1 | 8/2006 | Whitcomb | |
| 2008/0244987 | A1 | 10/2008 | Clausi | |
| 2010/0139872 | A1 * | 6/2010 | Caire | E04F 10/0607 160/46 |
| 2011/0049069 | A1 | 3/2011 | Kao | |
| 2011/0198041 | A1 * | 8/2011 | Svirsky | E04F 10/10 160/61 |
| 2012/0211179 | A1 | 8/2012 | Cutler et al. | |
| 2015/0376937 | A1 * | 12/2015 | Buermann | E04F 10/02 248/48.2 |
| 2021/0289709 | A1 | 9/2021 | Davis | |
| 2021/0388615 | A1 * | 12/2021 | Selzer | E04C 3/04 |

* cited by examiner

TARP SUPPORT APPARATUS AND SYSTEM

BACKGROUND OF THE INVENTION

1. Field of the Invention

The present invention relates generally to systems and methods for securing flexible protective coverings such as a weather-resistant tarp or canopy over an area.

2. Description of the Related Art

Flexible sheet-like materials are often used as covers to shield or protect vehicles, equipment, supplies, ground areas and the like from environmental elements including rain, wind, ultraviolet rays from the sun, and snow, as well as airborne dust, pollen and other debris. Common examples of such protective coverings are flexible tarpaulins or "tarps" and canopies, which may be formed of polyethylene, polyester, canvas, cloth, vinyl, and other suitable materials. Polyethylene tarps with woven fibers are particularly useful for many general applications in that they are relatively strong, lightweight, are waterproof, and are inexpensive. In some embodiments, spaced openings are provided along the periphery of the tarp sheet which openings are reinforced by grommets or eyelets to facilitate attaching various connectors to the tarp such as bungee cords, rubber tarp straps, ratchet straps, various hooks and the like and used to hold the sheet in a use position. If used as a sunshade, for example, the protective covering is secured extending overhead at a suitable height off the ground under tension to hold it in a stretched orientation. The covering may be secured extending between spaced-apart poles or another nearby supporting structure such as a wall or tree, typically by passing a hook or nail secured in the structure through the grommets or by utilizing a tarp strap or the like.

It may be desirable to periodically move or adjust the position of the flexible sheet covering, which requires detaching the covering from the fasteners, moving the fasteners to a new location and/or installing new fasteners in such location, and then reattaching the covering. In some cases, it may also be desirable to temporarily move the covering out of the way and then return it to the same position without having to detach and then reattach the covering and cords from the fasteners, which is time consuming and inconvenient. The support apparatus and system of the present invention therefore facilitates hanging and repositioning flexible coverings such as a tarp without disconnecting the covering from its fasteners. Further, while tarps are convenient for inexpensively covering small outdoor areas, if secured to a supporting wall just at the location of the spaced-apart grommets, gaps will form between the tarp edge and supporting wall through which rain and other debris landing on the tarp can fall, which is undesirable. A tarp support device which is also effective in diverting rain away from these gaps therefore would also be desirable.

SUMMARY OF THE INVENTION

The present invention is directed to an apparatus, system and method which in some embodiments is used for supporting a flexible protective covering such as a tarp under tension in a raised position extending over a ground area for various uses such as a shelter or to shield equipment, materials, supplies, and the like against environmental elements.

The support apparatus of the present invention includes an elongated structural member having parallel longitudinal tracks each having in some embodiments a C-shaped cross-section, which tracks are referred to individually herein as the upper track and the lower track. The elongated structural member is configured to be coupled to a wide range of generally vertical, flat, stable surfaces such as a building wall, fence, pole, or stud. In some embodiments, the structural members will be provided in different standard lengths such as in 8-foot, 10-foot, or 12-foot sections. Where a longer length is required, multiple structural members may be positioned end-to-end such that the overall length is easily adjusted to accommodate almost any size tarp or multiple tarps also laid end-to-end.

The support apparatus also includes one or more fastener devices which are configured to be secured in the lower track of the elongated structural member, which fasteners are slidable and repositionable on the lower track. The fasteners have a base member which is dimensioned to be received in the lower track, and a connector member secured to the base member which will extend outwardly from the base member through a slot in a front side of the lower track. In some embodiments, the base member is lockable against lateral sliding or movement in the lower track such that the fasteners can be secured at any desired spaced apart locations along the length of the lower track.

The tarp support apparatus also includes an elongated diverter member which is securable in the upper track of the structural member. The diverter member has a base and an extension portion secured to the base. The base of the diverter member is dimensioned to be secured in the upper track with the extension portion extending from the base forwardly and outwardly through a slot a forward side of the elongated structural member. The extension portion will have a width such that the distal end extends over the fastener devices in the lower track as well as over any gaps formed between the edge of the tarp and the supporting structural member in order to divert rain, snow, and other debris that otherwise might fall through one of such gaps away from the gaps.

The base member or track connecting portion of the fastener devices preferably can be selectively positioned along the length of the lower track by sliding the base member along the track. In some embodiments, the fastener devices may be releasably locked against movement in a desired location on the track, wherein to reposition the fastener device the base member is first released from a secured position, then repositioned or moved to a desired new location on the lower track, and then secured in the new portion. The connector member of the fastener devices in some embodiments will have a hook portion which can either be passed through a corresponding eyelet or grommet connected along on a side edge of the tarp, or a cord or strap may be connected extending between the eyelet of the tarp on one end and the hook portion on the other end. Such a cord or strap may similarly have a connector on its ends for securing the cord between the eyelet and hook portion.

In a preferred embodiment, the extension portion of the diverter member is hingedly connected to the base member, such that the distal end of the extension portion will pivot downwardly into contact with the upwardly facing surface of the tarp covering. Gravity will therefore continually urge the distal end of the extension portion into contact with the tarp covering, which will increase the effectiveness of the diverter member by inhibiting rain from flowing under the extension portion towards the edge of the tarp covering. In some embodiments, the outer or distal end of the extension portion will be weighted to further urge the distal end into contact with tarp and to inhibit the extension portion from being forced upwardly out of contact with the tarp covering due to wind forces under most standard wind conditions. In some embodiments the additional weight may be provided by a thickening of the material used in forming the distal end of the extension portion, or by inserting a suitably dense material such as sand, tungsten, lead, and other materials into a hollowed distal end of the extension portion. One or more channels may also be formed in the upper surface of the extension portion which will gather rain on the extension portion of the diverter member and direct it laterally toward the sides of the tarp covering.

Further areas of applicability of the present invention will become apparent from the detailed description provided hereinafter. It should be understood that the detailed description and specific examples, while indicating a preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
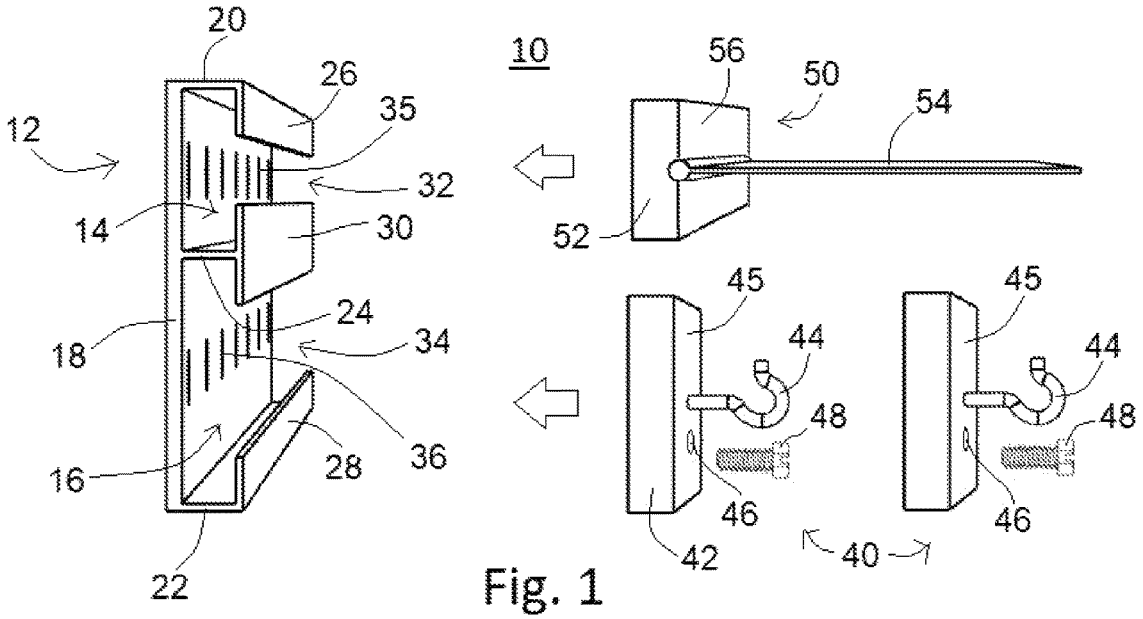
FIG. 1 is a side perspective view showing the components of an embodiment of the flexible covering support apparatus including the elongated structural member, fastener devices, and diverter member.
Figure 2:
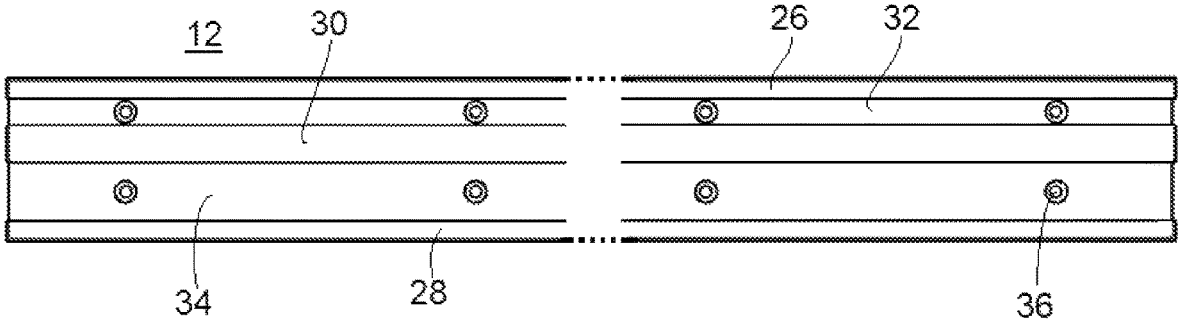
FIG. 2 is a partial front elevation view of the elongated structural member as in FIG. 1.

Reference will now be made in detail to embodiments of the present invention, examples of which are illustrated in the accompanying drawings. While the present invention will be described in conjunction with the several embodiment(s), the description is not intended to be understood in a limiting sense, but to be an example of the invention presented solely for illustration thereof, and by reference to which in connection with the following description and the accompanying drawings one skilled in the art may be advised of the advantages and benefits of the invention. On the contrary, the present invention is intended to cover alternatives, modifications, and equivalents, which may be included within the spirit and scope of the invention as defined by the appended claims. Further, it will be appreciated that embodiments of the present disclosure may employ any combination of features described herein. Descriptions of well-known starting materials, equipment, components, and processing techniques may be omitted so as to not unnecessarily obscure the embodiments herein.

In the description of the present invention, it should be understood that the terms "upper," "lower," "top," "bottom," "left," "right," and the like refer to orientations or positions based on those shown in the drawings. The terms are only for the convenience and simplification of the description of the present invention, rather than indicating or implying that the device or element referred to must have a specific orientation, or be constructed and operated in a specific orientation. The terms "first" and "second" do not represent the importance of components, and therefore cannot be construed as limiting the present invention. The specific dimensions used in describing the exemplary embodiments are only for illustrating the technical solution without limiting the protection scope of the present invention. Reference herein to a "first embodiment," "an embodiment," "another embodiment," and like terms means that a particular feature, structure, or characteristic described in connection with the embodiment is included in at least one embodiment of the disclosure. The phrases "in an embodiment" or "in one embodiment" as used herein are not necessarily all referring to the same embodiment, nor are separate or alternative embodiments mutually exclusive of other embodiments. Moreover, various features are described that may be exhibited by some embodiments and not by others. Similarly, various requirements are described that may be requirements for some embodiments but not others.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," "joined," or any variant thereof, means any connection or coupling, either direct or indirect, between two or more elements. Additionally, the words "herein," "above," "below," and words of similar import, when used in this document, shall refer to this document as a whole and not to any particular portions of this application. If the specification states a component or feature "may," "can," "could," or "might" be included or have a characteristic, that particular component or feature is not required to be included or have the characteristic.

As used herein, the singular forms "a," "an," and "the" include plural references unless the context clearly dictates otherwise. Unless defined otherwise, all technical and scientific terms used herein have the same meanings as commonly understood by one of ordinary skill in the art. When used in this document, the term "exemplary" is intended to mean "by way of example" and is not intended to indicate that a particular exemplary item is preferred or required. When terms such as "first" and "second" are used herein to modify a noun, such use is simply intended to distinguish one item from another, and is not intended to require a sequential order unless specifically stated.

Figure 5:
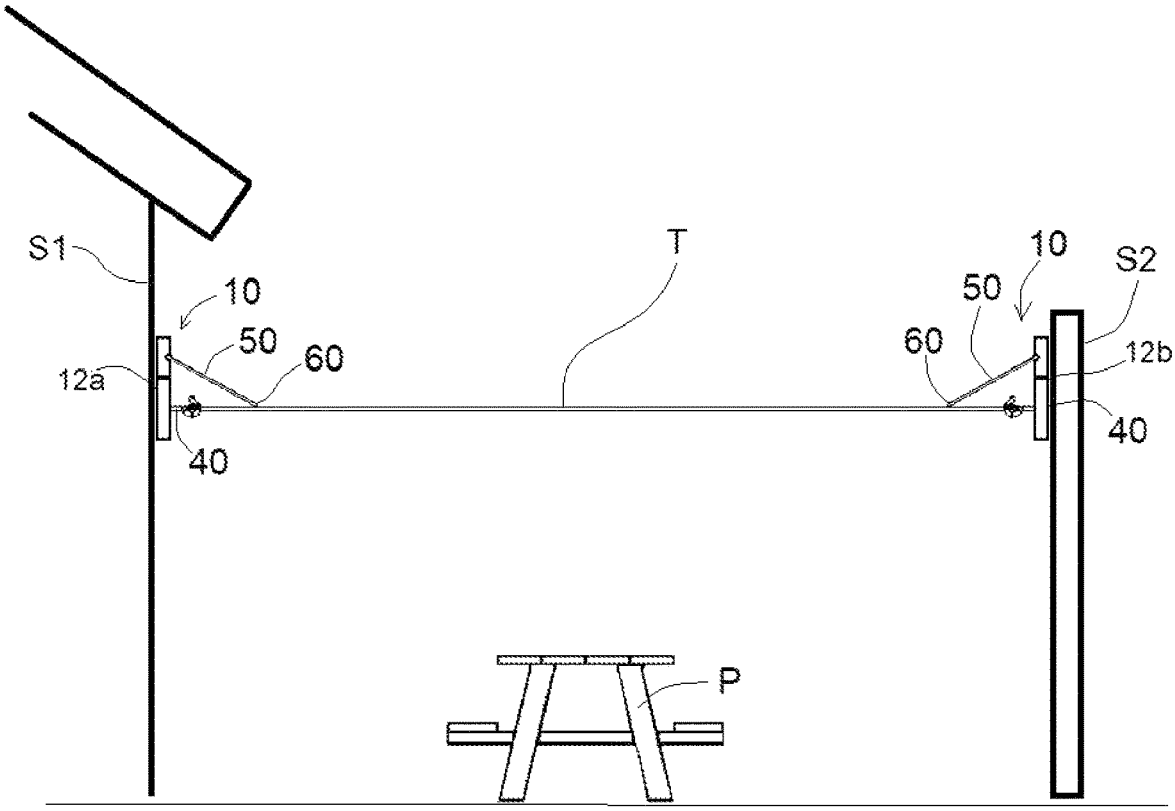
FIG. 5 a diagrammatic view illustrating the support apparatus in use supporting opposite side edges of a tarp extending over a ground area.
Figure 6:
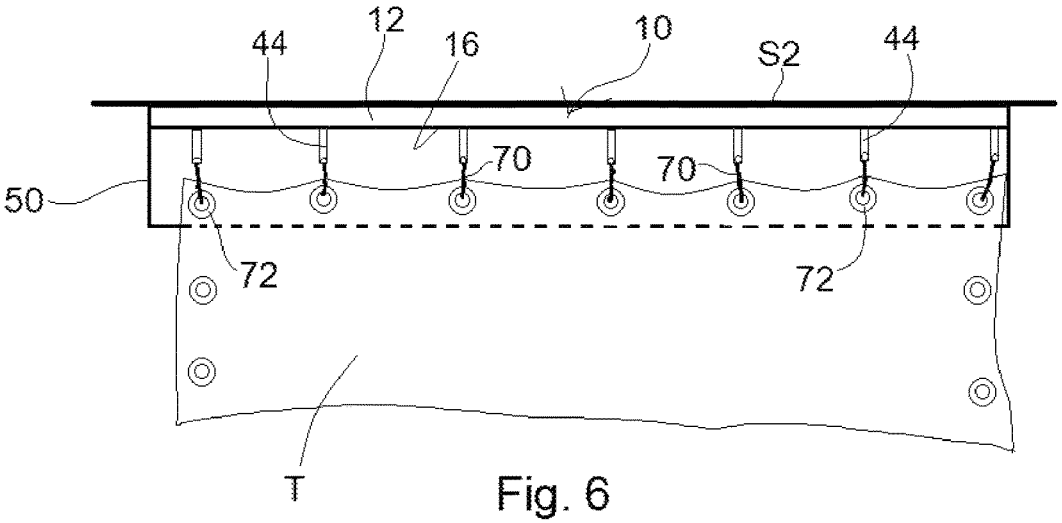
FIG. 6 is a partial bottom view of an embodiment the tarp support apparatus in use and showing the position of the diverter member in relation to the fastener members and side edge of the tarp.
Figure 7:
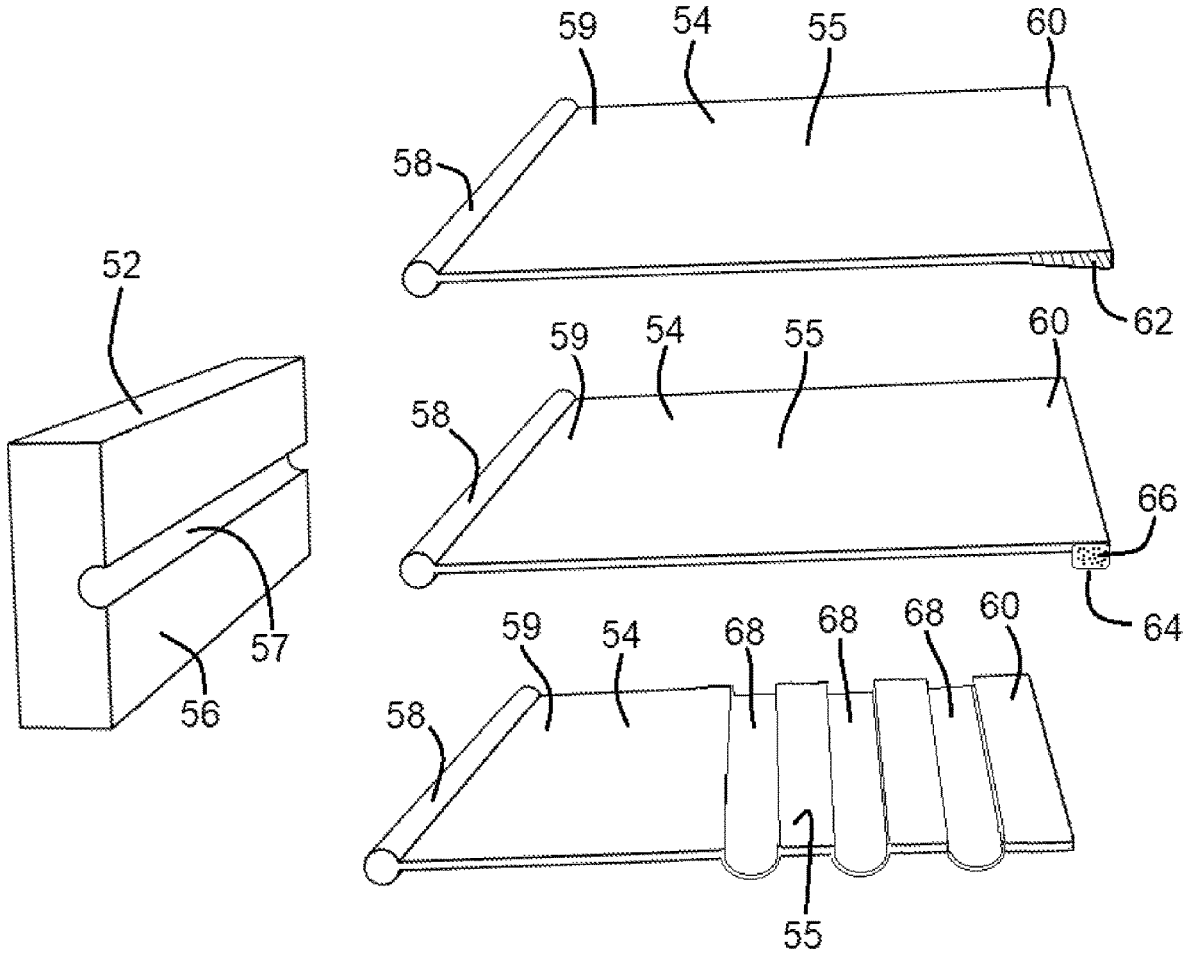
FIG. 7 is a perspective view of several alternative embodiments of the diverter extension member.
Figure 8:
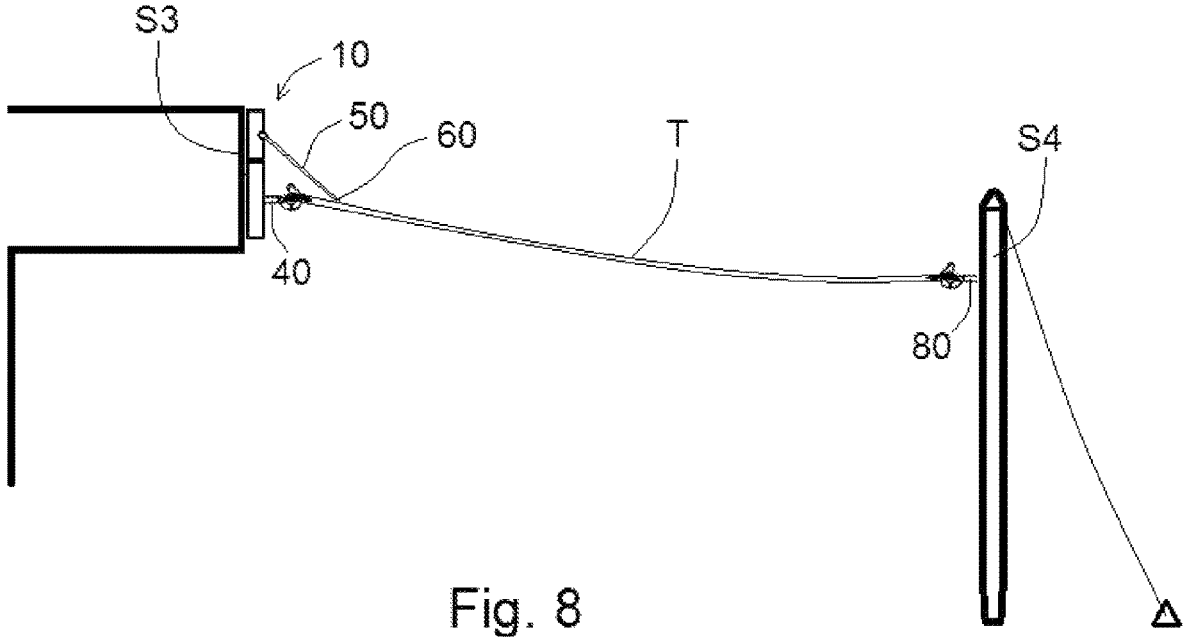
FIG. 8 is a diagrammatic view illustrating another manner of use of the support apparatus on one side edge of a tarp.
Figure 9:
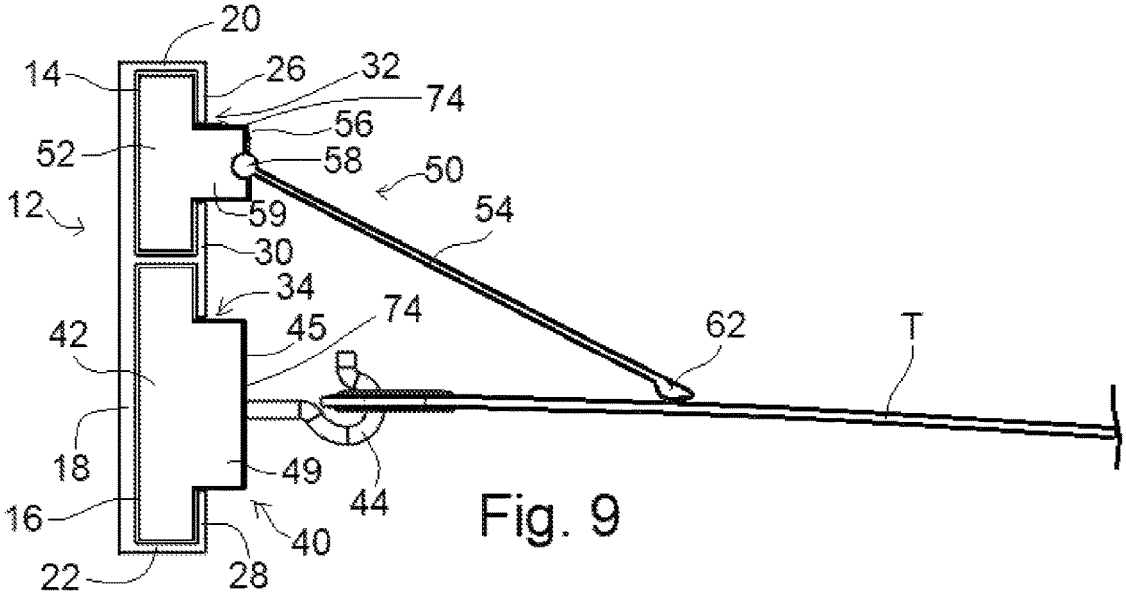
FIG. 9 is a side elevation view of another embodiment of the fastener device and structural member.

FIG. 1-6 illustrate the components of a tarp support apparatus 10 in accordance with an embodiment of the present invention, while FIG. 7-9 illustrate exemplary alternate embodiments and uses. Wherever possible, like reference numbers have been utilized to refer to like elements or features of the invention throughout the different embodiments illustrated herein. As shown in FIG. 1, the main components of the tarp support apparatus 10 are an elongated structural member 12, fastener devices 40, and diverter member 50. Structural member or rail member 12 has two longitudinally extending parallel track sections, referred to herein as upper track section 14 and lower track section 16. As oriented in FIGS. 1-4. upper track section 14 is positioned above lower track section 16 which normally will be the preferred use orientation. Both track sections 14 and 16 have a C-shaped cross-section with open outer ends, although in other embodiments the track sections may have a differently shaped profile and one or both outer ends may be closed or capped. Structural member 12 includes a web 18 which during use forms a vertical rear wall portion of the structural member 12, a top flange 20, a bottom flange 22, and an intermediate flange 24. Top flange 20 and bottom flange 22 are joined to opposite ends of the web 18, and intermediate flange 24 is joined to web 18 at an intermediate location between the top and bottom flanges 20 and 22. Top, bottom, and intermediate flanges 20, 22, and 24 project away from web 18 in the same direction, and in the exemplary embodiment extend perpendicular to web 18 and have the same length. In other embodiments, the flanges 20, 22, and 24 may project away from web 18 at other than a perpendicular angle such as an acute angle and may have different lengths. A downwardly directed rib 26 is connected to the outer edge of top flange 20, a upwardly directed rib 28 is connected to the outer edge of bottom flange 22, and a transverse rib 30 is connected to the outer edge of intermediate flange 24 which is extending transversely to flange 24. In the illustrated embodiment, upper, lower, and intermediate flanges 20, 22, and 24 therefore are substantially parallel, and ribs 26, 28, and 30 are substantially vertically aligned and parallel to web 18, although in other embodiments flanges 20, 22 and 24 and ribs 26, 28 and 30 may have different dimensions and angles. Upper track section 14 is configured to form an elongated interior channel defined by the inner walls of web 18, top flange 20, and rib 26, upwardly facing wall of intermediate flange 24, and the inner wall portion of rib 30 above intermediate wall 24. A slot 32 is formed between the outer edges of ribs 26 and 30, which slot 32 is open to the interior channel of upper track section 14. Lower track section 16 is configured to form an elongated interior channel defined by the inner wall of web 18, lower flange 22, and rib 28, the downwardly facing wall of intermediate flange 28, and the inner wall of the downwardly facing section of rib 30 below intermediate rib 24. A slot 34 is formed between the outer edges of ribs 28 and 30, which slot 34 is open into the interior channel of lower track section 16. The web 18, flanges 20, 22, and 24, and ribs 26, 28, and 30 will therefore be configured to form the desired dimensions of the interior channels of the upper and lower track sections 14 and 16.

The elongated structural member 12 will be fabricated of a suitable material including but not limited to stainless steel, aluminum, or other metal, plastic, composite material, wood, or combination of materials. Spaced-apart apertures 35 are formed in web 18 of upper track section 14 and spaced-apart apertures 36 are similarly formed in web 18 of lower track section 16. Apertures 35 and 36 are preferably horizontally aligned with slots 32 and 34, respectively, and may be used to facilitate securing the structural member 12 to a wall or other support surface using suitable fasteners 37 (FIG. 3), which may be nail or screw fasteners or other suitable fasteners. The fasteners 37 will be passed into the apertures 35 and 36 from the inner wall side of web 18 and then into the support surface.

Figure 3:
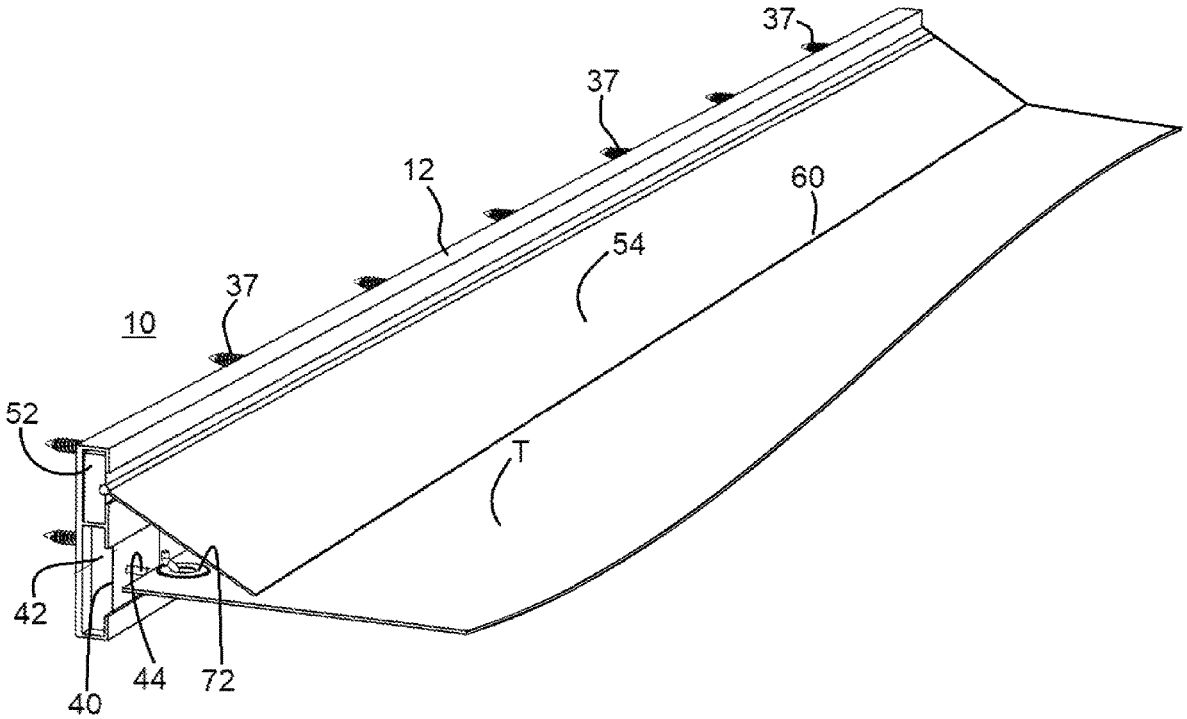
FIG. 3 is a perspective view of a tarp secured to the support apparatus in accordance with the invention.

The support apparatus 10 also includes one or more individually positionable fastener devices 40, an exemplary embodiment of which is shown in FIG. 1. Fastener device 40 has a base member 42 and a connector member 44 which is joined to base member 42 in a position extending outwardly from side wall 45 of the base member 42. Base member 42 may be a block, plate or other suitable member which is configured and dimensioned to be positioned in the channel of lower track section 16 by inserting the base member 42 into the lower track section 16 from an end of the lower track section 16. Base member 42 is also configured to be movable longitudinally in lower track section 16 by manually sliding the base member 42 in the lower channel. As shown in FIG. 1, the lower track section 16 has a rectangular cross-sectional profile, and the exemplary embodiment of base member 42 of fastener device 40 therefore has a similar cross-section with slightly smaller dimensions than lower track section 16 and is configured to fit snugly in lower track section 16. In some embodiments, base member 42 may be other than rectangular such as including but not limited to being triangular in shape, although the base member 42 should still fit snugly in the lower channel. As shown in FIG. 3, when base member 42 of fastener device 40 is positioned in the lower channel 16, connector member 44 will extend outwardly through the slot 34 formed between ribs 28 and 30. In some embodiments, and as shown in FIG. 9 the outwardly facing wall 45 of base member 42 may have a portion dimensioned to protrude through slot 34 in the lower track section 16.

Connector member 44 is joined to base member 42 by a means suited to the materials used, which means may include but is not limited to screw threads, welding, molding, or an adhesive. Connector member 44 is used to detachably secure a flexible sheet or panel such as a weather-resistant tarpaulin T shown in FIGS. 3 and 5-6 to the structural member 12 along a side edge of the tarp T. In some instances, the weather resistant flexible panel T will have a series of evenly spaced-apart eyelets or grommets 72 provided along a periphery of the panel. For example, the grommets 72 may be spaced apart between 18 and 30 inches depending upon the weight or material of the tarp T. It will be understood that as many connector members 44 as are needed to secure the tarp T to a support structure will be positioned in the lower track section 16. In some embodiments, the connector members 44 may be spaced apart in approximately the same spaced relation as the eyes or grommets 72 of the tarp T to secure the tarp T at the location of each of the grommets. The connector members 44 will be made of a suitable material such as a corrosion and rust resistant zinc alloy, other metals, plastics, or other materials, and may be formed integrally with the base member 42 or connected to the base member 42 such as by a screw hook or other means. While in the exemplary embodiment the connector members 44 are shown as conventional hook fasteners, in some embodiments the hook or attachment portion of connecting member 44 will have a spring closer member or snap hook which extends across the mouth of the hook portion to prevent the hook portion 44 from easily becoming disengaged from the grommet 70. The connector members 44 therefore may comprise an eye hook, clevis hook, sling hook, self-locking hook, snap hook, carabiner, or other suitable joining member.

In some embodiments, the fastener devices 40 will be securable against lateral sliding in the lower track 16. In an embodiment, a threaded through-aperture 46 (FIG. 1) will be formed in the base member 42 of fastener device 40 extending between inner and outer facing side walls, and a threaded fastener such as a bolt member 48 will be inserted in the aperture. Once the base member 42 is positioned as a desired longitudinal location in the lower track 16, the fastener 48 is rotated until the outer end of the threaded shaft is forcibly pressing against the inner wall of web 18 in lower track 16. This will cause the base member 42 to be urged forwardly in lower track 16 until the outwardly facing wall 45 of the base member 42 is pressing against the inner walls of the ribs 28 and 30. This will cause the base member 42 to be frictionally engaged with the inner walls of ribs 28 and 30, frictionally securing the base member 42 against longitudinal sliding. In some embodiments the outer end of the bolt shaft may be capped or coated with a rubber or plastic material to protect the web 18 and bolt from wear. Other arrangements for securing the fastener devices 40 against lateral sliding such as a spring clip member positioned around the base member 42 which will continually press against the inner walls of the lower track 16, may be alternatively provided while still falling within the intended scope of the present invention.

In use, the structural member or tarp support structure 12 of the tarp support apparatus 10 will be secured by fasteners 37 to a structure such as a building wall in close proximity to an area to be covered by a tarp T. Normally, upper and lower track sections 14 and 16 will extend substantially horizontally although the structural members 12 can be oriented at other angles as needed to suit the particular intended purpose. When the tarp or panel T is secured extending between the structural members 12 as shown in FIG. 5, since the grommets 72 are spaced apart as described above, as shown in FIG. 6 there will be a gap or gaps between the edge of the tarp T secured to fasteners 42 and structural member 12. In order to prevent rainwater as well as other small debris such as leaves, pine needles from trees, and the like from gathering along the tarp edge and falling through these gaps, the tarp support apparatus 10 also includes a diverter 50 which is secured in the upper track section 14. In use diverter 50 will normally be positioned directly over the connector member 44 of fastener devices 40 in the lower track section 16. Diverter 50 will therefore redirect rainwater and other debris that otherwise may fall or drip through such gaps between the side edge of the tarp connected to lower rail 16 of the support structure 12 away from these gaps.

Elongated diverter 50 includes a base 52 and an extension member 54. Base 52 is dimensioned to fit snugly in the channel of the upper track section 14 of support structure 12 when inserted from an outer end of the channel. As shown in FIG. 1, the channel formed by upper track section 14 has a rectangular profile, and therefore base 52 in an embodiment will have a similar rectangular profile with slightly smaller dimensions than the channel, while in other embodiments, the base 52 may have other profiles such as a triangular profile. Extension member or portion 54 is joined to the base 52 along a side wall 56 of the base 52 and is oriented extending away from side wall 56. Diverter 50 will preferably extend along the entire longitudinal length of the upper track section 14, and in an embodiment will have a length that is substantially equal to the longitudinal length of the upper track section 14 of structural member 12. In other embodiments, diverter 50 may have a length greater than the longitudinal length of the upper track section 14 so the diverter 50 can extend between two or more aligned structural members 12, or in still other embodiments may be provided in shorter sections that are secured in an end-to-end relationship in the upper track section 14 of a single support structure or structural member 12. When base 52 of diverter 50 is positioned in the channel of upper track section 14, the extension member 54 will extend away from side wall 56 of base 52 and outwardly through the slot 32 formed between ribs 26 and 30 of the support structure 12.

Base 52 and extension member 54 of diverter 50 will be made of a suitable material such as but not limited to metal or plastic, and base 52 may be made of a different material than extension member 54. In some embodiments, extension member 54 will be sufficiently rigid to support its own weight and remain in an extended use orientation, while in other embodiments may be bendable or angled into a desired position. One or more stiffening members or ribs, not shown, may be integrally formed or provided with the extension member 54 to minimize deformation, and other means of support may also be utilized as long as this does not interfere with positioning the base member 52 in the upper track section 14. While in some embodiments elongated structural member 12 and diverter 50 could be integrally formed as a single component, it is preferable that structural member and diverter 50 are formed as separate components with the base 52 configured to be joined to the structural member 12 in the upper track section 14, as the structural member 12 and diverter 50 therefore may be formed of different materials. Forming the structural member 12 and diverter 50 separately also facilitates ease of shipping of the assembly by enabling the diverter to be laid flat with the structural member in a more compact shipping box. The extension member 54 may also be provided in different widths so the apparatus 10 can more easily customized to the user's requirements. In some embodiments, for example, extension member 54 will have a width of between above five inches and seven inches extending outwardly from base 52, while in other embodiments the extension member 54 may have a greater or lesser width. In a more preferred embodiment, extension member 54 will have a width of about six inches.

Figure 4:
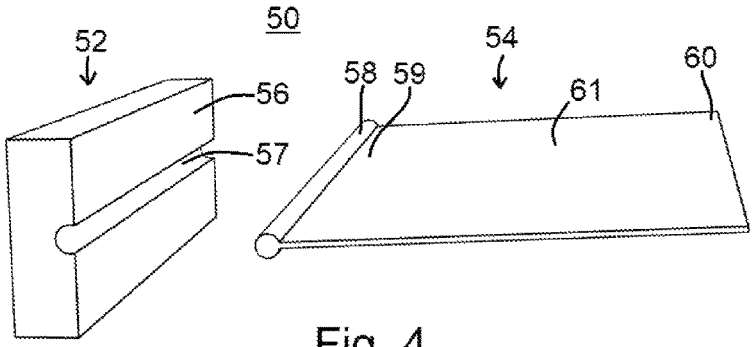
FIG. 4 is a perspective exploded view of an embodiment of the diverter member.

Extension member 54 in the exemplary embodiments is articulating, allowing for pivotal movement of the extension member 54 with respect to base 52 within a predetermined range of motion. A hinge joint for pivotally joining the extension member 54 to base member 52 is provided. As shown in FIG. 4, a rounded, concave groove 57 is formed in a side wall 56 of base 52, and a corresponding rounded, convex pivot member 58 is formed on or affixed to the proximal end 59 of extension member 54 which pivot member 58 is configured to be positioned in the groove 57. Extension member 54 therefore will be able to pivot freely with respect to base 52 within a predetermined range of motion. A hinge joint between base 52 and extension member 54 is preferred because articulating motion is only permitted in a single plane and therefore will prevent the extension member 54 from pivoting out of such plane. In some embodiments, extension member 54 is pivotable within a range of about 160 degrees, while in other embodiments extension member 54 will be pivotable within a greater or lesser range. During use of the tarp support apparatus 10, as shown in FIG. 3, the distal end 60 of the extension member 54 will pivot downwardly under its own weight into contact with the upwardly facing surface of tarp T, which is secured to the support structure 12 by fastener members 40 positioned in lower channel section 16 and hooks 44 which are secured in grommets 72. The articulating structure of the diverter 50 will continually urge the distal end 60 of the extension member 54 into contact with the tarp T, which will provide a better connection or seal between the extension member 54 and tarp T and will reduce leakage between the extension member 54 and tarp T.

In some embodiments, the distal end 60 of the extension member 54 may be additionally weighted. The additional weight will reduce the tendency of the extension member 54 to raise or lift upwardly off of the tarp T during times of stronger winds, which often increase significantly during rainy or stormy periods. The added weight therefore will better maintain the distal end 60 of the extension member 54 downwardly sloped or angled and in contact with the upwardly facing surface of tarp T during most normal weather conditions. As shown in FIG. 7, in some embodiments the weight of distal end 60 is increased by forming a thickened area 62 in distal end 60 of diverter extension member 54. For example, if the extension member 54 is formed of molded plastic, thickening of the distal end 60 to increase the weight may be accomplished during the molding process. In other embodiments, a hollow cavity 64 may be formed in the distal end 60 of the extension member 54 which is then filled with a weighted material 66 such as sand or other materials. The weight material 66 will be sealed in the cavity 64 to provide the added weight. In other embodiments, a weighted strip may be secured to the underside of the diverter extension member 54 in proximity to distal end 60. The additional weight provided on the distal end 60 of the extension member 54 should not to inhibit or block rainwater from flowing down the extension member 54 on to the tarp T, and therefore is preferred that the top surface 55 of the extension member 54 in such embodiments remains substantially flat at distal end 60. In another embodiment, longitudinal channels 68 will be formed in the top surface 55 of extension member 54, one of which is preferably in proximity to the distal end 60. Channels 68 may be differently dimensioned and angled to capture and divert substantial amounts of water collecting on the top surface 55 of extension member 54 away from the distal end 60 of the extension member 54 before it flows on to the tarp T. The channel 68 will direct the water towards the side edges of the tarp T. The distal end 60 of the diverter extension member 54 having channel 68 may also be weighted as in the other embodiments.

In FIG. 5, structural apparatus 12*a* is shown secured to a vertical wall of a building S1, and another structural apparatus 12*b* is shown secured to an opposite vertical surface S2 such as a fence, building overhang, or another wall which is spaced apart from structural apparatus S1. A tarp T or similar sheet-like protective covering is secured by tarp fastener devices 40 under tension extending between structural apparatuses 12*a* and 12*b*. As a result, the tarp T is secured under tension extending over a ground area with picnic table P. Diverters 50 are positioned directly over the fastener devices 40 in the upper track 14 with distal end 60 of the extension member 54 engaged against the upwardly facing surface of the tarp T. Although not shown in FIG. 5, despite being secured to structural apparatuses 12 and 12*b* under tension, the tarp T will naturally sag, but the articulating diverter extension member 54 will pivot downwardly to remain in contact with the upwardly facing surface of the tarp T. The fastener devices 40 are movably adjustable to accommodate different tarp configurations, and as shown in FIG. 6 may be spaced apart in lower track section or rail 16 of structural apparatus 12 at approximately the same distance as grommets 72 of tarp T. The grommets 72 may be joined directly over the hook fasteners 44 of each fastener device 40, or as shown in FIG. 6 may be indirectly joined to hook fasteners 44 by ropes, straps or bungee cords 70 with one end connected to the grommets 72 and the other end connected to the hook fasteners 44. Use of the intermediate straps or cords 70 may create a slightly larger gap along the side edge of tarp T connected to the support structure 12, but may be necessary in some cases to properly position the tarp T as desired.

In order to connect the fastener devices 40 to the grommets 72 of the tarp T, the fastener devices 40 are first slidably positioned on the lower track 16 in a spaced-apart orientation. As shown in FIG. 1, the fastener devices 40 are locked at a desired location along the length of the track 16 by a suitable means such as by passing a threaded bolt 48 into an aperture 46 in the base member 42 of the tarp fastener devices 40. Rotation of the locking screw in a first direction will cause the outer end of the locking screw to forcibly press against the inner surface of the rear wall of lower track 16. This will cause the front surface the base member to be forcibly pressed in an opposite direction against an inner surface of the arms 28 and 30. The aperture in base member 42 in which the locking screw is received will preferably be substantially aligned with the slot 34 in the track 16 such that the locking screw can be easily rotated to be locked an unlocked using a screwdriver or screwdriver drill bit passed into the track 16 via slot 34. In another embodiment, a spring member or members may be provided along the inner surfaces of the upper and lower legs of lower track 16. The spring members will resultingly exert a constant outward force or tension against the upper and lower side surfaces of the base member 42 of the tarp fastener devices 40 when the base members 42 are slidingly inserted into track 16. To slidingly reposition the fastener devices 40, the user can manually grasp the fastener device 40 by the hook portion 44 in order to urge the base member upwardly or downwardly in the channel of track 16. This will cause the spring, depending on whether the base member 42 is pressed upwardly or downwardly, to be urged inwardly and temporarily reduce the combined force exerted on the base member 42 by the springs enough for the fastener device 40 to be manually slid in either direction in the channel to a new use position. Then, when the repositioned fastener device 40 is released, the spring members will again automatically engage with the base member 42 and hold the tarp fastening member 40 in the new position.

In another embodiment for securing or locking the tarp fastener devices 40 at a desired location along the length of track 16, instead of a spring member being installed in the channel of track 16, a spring member is secured along the outer surface of the base member 42 of each of the tarp fastener devices 40. The spring member would have an outwardly curved portion which extends along the rear surface of the base member 42, and a pointed bottom portion extending downwardly from the lower surface of the base member 42. The outwardly curved section and pointed bottom section provide a constant outward tension force on the base member 42, continually urging the base member 42 against the top and front inner surfaces of the track 16 sufficient to hold the fastener devices 40 in position in the track 16. To move or relocate the tarp fastener devices 40, the fastener device 40 is pressed downwardly and rearwardly in the channel, which will cause the pointed bottom section and outwardly curved section of the spring member to moved towards the securing member. At the same time, the fastener device 40 is released and can be slide in the track 16. The user then simply releases the fastener device 40 when it has been moved to a desired new position, wherein the spring tension will be sufficient to maintain the securing member in the new position up to a predetermined maximum.

The present invention can be used to support flexible covers or tarps in a wide range of applications which may range from lightweight to heavy duty uses, as well as covers or tarps manufactured of different materials such as canvas, vinyl, poly, mesh, or nylon. The apparatus 10 can be used to secure a flexible covering in position for many different possible uses such as a patio cover, trailer cover, breezeway cover connecting between two buildings, rain shield, and so on. In some embodiments the elongated structural members 12 are mounted on opposite sides of an area to be covered and may be secured at the same height as in FIG. 5, or may be at different heights such that the tarp will be at an angle, which will urge water falling on the tarp to drain in a desired direction. FIG. 8 illustrates another manner of use wherein one apparatus 10 is secured to vertical wall S3 of a building overhang. A side edge of tarp T is secured to fasteners 40 of apparatus 10 as described above, while the opposite side edge of tarp T is secured to one or more hooks 80 connected to upright posts S4 which may be supported by a ground stake and rope. As compared to FIG. 5 wherein tarp T is shown connected extending between two apparatuses 10 coupled to opposite building wall S1 and wall S2, in FIG. 8 only one apparatus 10 attached to overhang S3 is used, and in addition the tarp T is angled downwardly towards post S4 so that water and other debris contacting the upwardly facing surface of tarp T will naturally drain away from structure S3 and towards post S4. Thus, depending upon the particular desired configuration or mode of use, the apparatus 10 may be used alone or in combination with another apparatus 10 secured to another support structure, or may be used alone.

FIG. 9 illustrates another embodiment of the invention in which in addition to base member 42 of fastener device 40 being dimensioned to fit snugly in lower track section 16, fastener device 40 additionally has an extension portion 49 which may be formed integrally with base member 42 and is configured to extend outwardly through the front slot 34 of the structural member 12. In addition, base member 52 of diverter 50 which is dimensioned to fit snugly in upper track section 14 similarly has an extension portion 59 configured to extend outwardly through front slot 32. Extension portions 49 and 59 protrude away from structural or rail member 12 and in some cases will provide a sturdier and closer fit in the track sections 14 and 16, and may be useful in supporting longer, heavier diverter portions 54 and adjusting the attachment location of tarp T. A rubber covering or gasket 74 may be provided over the outer surfaces 45 and 56 of the extension portions 49 and 59 to inhibit intrusion of water into the track sections 14 and 16.

The foregoing description has been presented for purposes of illustration and description and is not intended to be exhaustive or to limit the invention to the precise form disclosed. The descriptions were selected to explain the principles of the invention and their practical application to enable others skilled in the art to utilize the invention in various embodiments and various modifications as are suited to the particular use contemplated. Although particular constructions of the present invention have been shown and described, other alternative constructions will be apparent to those skilled in the art and are within the intended scope of the present invention.

What is claimed is:

1. A tarp support apparatus comprising:

an elongated structural member configured to be secured to a vertical wall, said elongated structural member including longitudinally extending upper and lower parallel track sections each having a C-shaped cross section defining an interior channel, and a slot which opens into the interior channel;

a plurality of fastener devices each including a base member configured to be longitudinally positioned in the interior channel of the lower track section, and a connector member joined to the base member and configured to detachably join a tarp to the fastener device; and an elongated diverter member including a base configured to be positioned in the interior channel of the upper track section, said base having a side wall and a concave groove formed in the side wall, and an articulating extension member joined to the base having a proximal end, a distal end, and a convex pivot member formed on the proximal end and positioned in the concave groove of the base, the extension member configured to extend away from the base through the slot opening into the interior channel of the upper track section and over the connector member of the fastener device;

wherein the support apparatus is configured to support the tarp extending over a ground area under tension in a stretched orientation, with the distal end of the articulating extension member of the diverter member articulated into physical contact with the tarp to direct rain and debris landing on the extension member away from any gaps formed between the structural member and an edge of the tarp.

2. The tarp support apparatus according to claim 1 wherein the diverter member has a length dimensioned to correspond to a length of the upper track section.

3. The tarp support apparatus according to claim 1 wherein the distal end of the extension member of the diverter has a weight greater than a weight of the proximal end.

4. The tarp support apparatus according to claim 3 wherein the distal end of the extension member has a thickness greater than a thickness of the proximal end.

5. The tarp support apparatus according to claim 3 further comprising a cavity formed in the extension member in proximity to the distal end of the extension member, said cavity adapted to receive a weighted material.

6. The tarp support apparatus according to claim 1 further comprising one or more longitudinally extending drain channels provided in the extension member of the diverter member.

7. The tarp support apparatus according to claim 1 wherein the base member of the fastener device is securable against longitudinal movement in the lower track section.

8. The tarp support apparatus according to claim 7 further comprising a threaded aperture in the base member of the fastener device configured to receive a bolt member for locking the base member against longitudinal movement in the lower track section.

9. The tarp support apparatus according to claim 1 where the elongated structural member additionally comprises a web forming a vertical rear wall, a top flange and a bottom flange joined to opposite ends of the web, an intermediate flange, said top, bottom and intermediate flanges extending away from the rear wall in a same direction, a downwardly directed rib connected to an outer edge of the top flange, and upwardly directed rib connected to an outer edge of the bottom flange, and a transverse rib connected to an outer edge of the intermediate flange, the slot which opens into the interior channel of the upper track section defined between the downwardly directed rib and transverse rib, and the slot which opens into the interior channel of the lower track section defined between the upwardly directed rib and transverse rib.

10. The tarp support apparatus according to claim 9 further comprising an aperture in the vertical rear wall of the structural member for receiving a wall fastener.

11. A tarp support apparatus comprising:

an elongated structural member, a diverter member, and one or more fastener members configured for securing a tarp to the support apparatus, the structural member including an upper track configured to receive and support the diverter member, said upper track having a front opening into the upper track, and a lower track configured to receive and support the one or more fastener members, said lower track having a front opening into the lower track;

the one or more fastener members each including a base member which is securable to the lower track and a connecting member coupled to the base member configured to extend away from the front opening into the lower track;

the diverter member including a base securable to the upper track and an extension member coupled to the base and configured to extend away from the front opening into the upper track;

wherein when the tarp is secured to the one or more fastener members secured to the lower track the extension member will extend over any gaps formed between the tarp and the structural member.

12. The tarp support apparatus according to claim 11 wherein the base member of the fastener members is movable along the lower track.

13. The tarp support apparatus according to claim 11 wherein the base member of the fastener members is lockable against sliding movement in the lower track.

14. The tarp support apparatus according to claim 11 wherein the extension member of the diverter member is pivotably joined to the base of the diverter member.

15. The tarp support apparatus according to claim 11 wherein the extension member of the diverter member has a width such that a distal end of the extension member will be supported on the tarp secured to the fastener members.

16. The tarp support apparatus according to claim 15 wherein the distal end of the extension member of the diverter member has a weight greater than a weight of the proximal end.

17. The tarp support apparatus according to claim 15 wherein the distal end of the extension member of the diverter member has a thickness greater than a thickness of the proximal end.

18. The tarp support apparatus according to claim 16 further comprising a hollow cavity formed in the extension member in proximity to the distal end in which a weighted material is received.

19. The tarp support apparatus according to claim 15 further comprising one or more longitudinally extending drain channels in the extension member of the diverter member.

20. The tarp support apparatus according to claim 11 wherein the base member of the fastener members and the base of the diverter member each further comprise an extension portion which extends out of the front opening of the corresponding upper and lower track, and a rubber gasket provided over an outer surface of the extension portion to inhibit moisture from entering the tracks.

* * * * *